US007232389B2

(12) United States Patent
Monteleone

(10) Patent No.: US 7,232,389 B2
(45) Date of Patent: Jun. 19, 2007

(54) WOUNDED ANIMAL TRACKER

(76) Inventor: Adam Monteleone, 189 Rabbit Run Rd., Clintondale, NY (US) 12515

( * ) Notice: Subject to any disclaimer, the term of this patent is extended or adjusted under 35 U.S.C. 154(b) by 221 days.

(21) Appl. No.: 10/970,976

(22) Filed: Oct. 22, 2004

(65) Prior Publication Data

US 2006/0089216 A1 Apr. 27, 2006

(51) Int. Cl.
*F42B 6/04* (2006.01)

(52) U.S. Cl. ..... 473/578

(58) Field of Classification Search ..... 473/578
See application file for complete search history.

(56) References Cited

U.S. PATENT DOCUMENTS 4,557,243 A 12/1985 Eastman, II et al.
4,704,612 A * 11/1987 Boy et al. ..... 342/386
4,836,557 A 6/1989 Polando
4,885,800 A * 12/1989 Ragle ..... 455/98
4,940,245 A * 7/1990 Bittle, Jr. ..... 473/570
4,976,442 A 12/1990 Treadway
5,022,658 A * 6/1991 Burkhart ..... 473/578
5,251,907 A 10/1993 Ady
5,446,467 A * 8/1995 Willett ..... 342/386
5,450,614 A 9/1995 Rodriguez
6,409,617 B1 6/2002 Arnold
6,612,947 B2 * 9/2003 Porter ..... 473/578
6,856,250 B2 * 2/2005 Hilliard ..... 340/573.2

* cited by examiner

*Primary Examiner*—John A. Ricci

(57) ABSTRACT

A Device for Locating a Wounded Animal for mounting on an arrow that has a head and a shaft. The Device is mounted on the head adjacent the shaft. A collar with a circular cross section has a plurality of prongs preferably mounted equi distant about the collar. The prongs are located at an acute angle to the collar. A signaling unit is located in each prong. The prongs are perforated adjacent the collar so as to break off easily. Upon impact of the arrow, at least one of the prongs breaks off and sticks in the animal. A transmitting unit in the prong permits ready location of the wounded animal.

12 Claims, 3 Drawing Sheets

WOUNDED ANIMAL TRACKER

BACKGROUND OF THE INVENTION

1. Field of the Invention

The present invention relates to a device for locating a wounded animal, and more specifically, to a three pronged device which utilizes a signaling unit for locating a game animal wounded by a bow hunter.

2. Prior Art

Various patents have previously dealt with devices for locating either a lost arrow or a wounded game animal which, although injured, sufficiently survived to escape from the location where it was wounded.

In the Eastman II et al Patent, U.S. Pat. No. 4,557,243, a string container is mounted on the bow and the string is connected to the arrow. When the arrow is shot, the string is played out and, by following the string, the arrow can be located.

The Rodriguez Patent, U.S. Pat. No. 5,450,614, teaches a transmitter on an arrow that when implanted into the body of an animal, transmits a radio signal. By use of a receiver of the radio signal, the wounded animal can be located.

The Ragle Patent, U.S. Pat. No. 4,885,800, uses a transmitter embedded in the shaft of an arrow which energizes on impact and which uses a receiver in conjunction with the transmitter to locate the arrow.

The Arnold Patent, U.S. Pat. No. 6,409,617, is still another example of the use of a radio transmitter mounted in an arrow which is used in conjunction with a receiver.

Each of these devices use a radio transmitter, places the transmitter somewhere in the arrow within the shaft or the head of the arrow.

The current invention utilizes a unique attachment to the arrow that provides multiple opportunities to be retained in the flesh of the animal even if the arrow and arrow head should drop from or be pulled from the flesh of the animal. The current invention further provides for use of the Global Positioning System (G.P.S.) as the signaling unit.

Objects

The objects of the invention are as follows:

1. To provide a wounded animal locator with a signaling unit.
2. To provide a wounded animal locator that provides multiple opportunities to be retained in the flesh of the animal even if the arrow itself is not retained in the animal.
3. To provide a device for locating a wounded animal that readily attaches to an arrow and is produced apart from the arrow.
4. To provide a wounded animal locating device that is economical.
5. To provide a wounded animal locator that is dependable.
6. To provide a wounded animal locator that can be operated on the Global Positioning System (G.P.S.).

SUMMARY OF THE INVENTION

A Device for Locating a Wounded Animal is mounted on an arm which has a head and a shaft. The Device is mounted on the head adjacent the shaft. The Device includes a collar. At least one prong is mounted on the collar at an acute angle to the collar. The prong has a base connected to the collar and a tip that is pointed. A signaling unit is mounted on the prong.

BRIEF DESCRIPTION OF THE NUMERAL

BRIEF DESCRIPTION OF THE NUMERAL

| NUMERAL | DESCRIPTION |
|---|---|
| 11 | PRONGED DEVICE |
| 13 | PRONGS |
| 15 | SIGNALING UNIT |
| 17 | ARROW |
| 19 | COLLAR |
| 21 | FRONT SIDE |
| 23 | REAR SIDE |
| 25 | OUTSIDE SURFACE |
| 27 | PASSAGEWAY |
| 29 | LONGITUDINAL AXIS |
| 31 | TWO EDGES |
| 33 | OUTSIDE EDGE |
| 35 | INSIDE EDGE |
| 37 | TEETH |
| 39 | ANIMAL |
| 41 | TWO ENDS (PRONG) |
| 43 | BASE |
| 45 | TIP |
| 47 | PERFORATION |
| 49 | ACUTE ANGLE |
| 51 | SIGNALING UNIT |
| 53 | HEAD |
| 55 | SHANK |
| 57 | BACK END |
| 59 | POINT |
| 61 | SHAFT |

DETAILED DESCRIPTION OF THE PREFERRED EMBODIMENT

Figure 1:
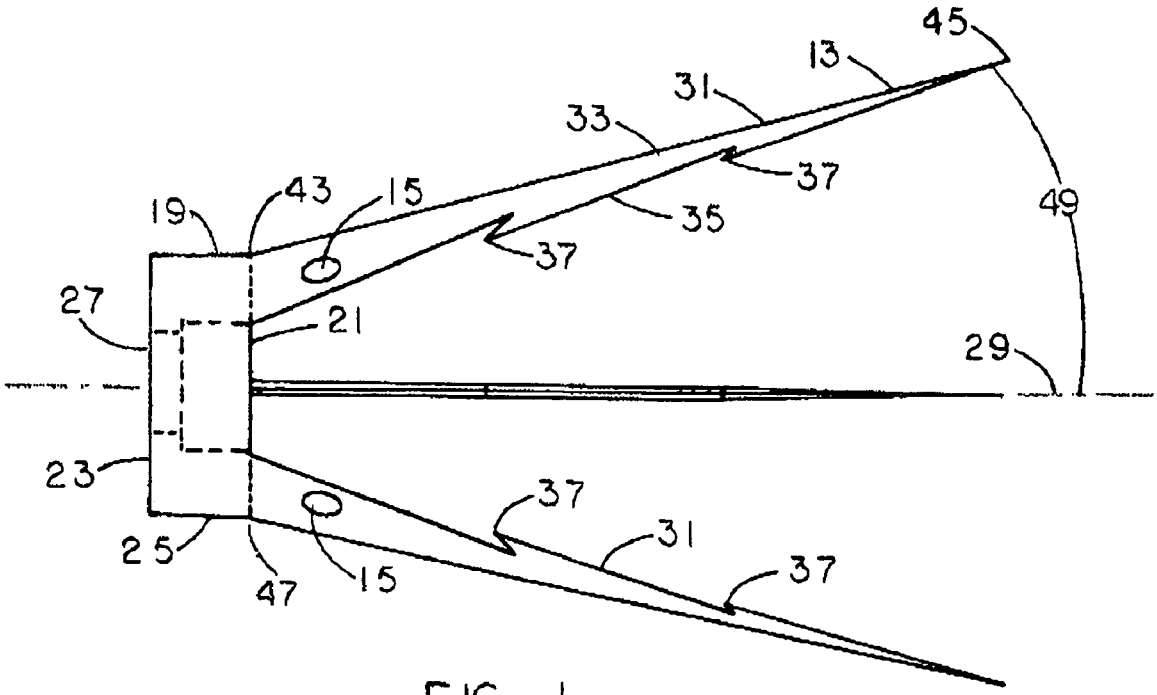
FIG. 1 is a pictorial view of the Device with three prongs.

Referring now to FIG. 1, a pronged device 11 is shown. The pronged device 11, with a signaling unit 15 in each of the prongs 13 is the Device for Locating a Wounded Animal. The Device for Locating a Wounded Animal is used with an arrow 17 and thus pertains to bow hunting.

The pronged device 11 includes a collar 19. The collar 19 has a circular cross section and has a front side 21 and a rear side 23. The collar 19 also has an outside surface 25 and has a passageway 27 through it. The passageway has a longitudinal axis 29.

The prongs 13 are affixed to the collar 19 on its outside surface 25. The three-prongs 13 each has essentially the same size and shape. Each prong 13 has two edges, namely an outside edge 33 and an inside edge 35. One of the two edges 31, preferably the inside edge 35 is jagged, having teeth 37 on it to cause a prong 13 to remain in an animal 39 into which the prong 13 has been thrust.

Each prong 13 has two ends 41, namely a base 43 and a tip 45. The tip 45, as would be expected, is pointed so that the prong 13 will pierce the skin of an animal 39. The base 43 is the broadest part of each prong 13. The prongs 13 taper from the base 43 to the tip 45.

At the base 43, each prong 13 has a perforation 47. This permits each prong 13 to break off the collar 19. In this way, the prong will remain embedded in an animal 39 even if the arrow 17 on which the pronged device 13 is mounted falls from the animal 39.

The three prongs 13 all are pointed in the same direction over the front side 21 and away from the rear side 23 and the front side 21 of the collar 19. The prongs 13 are generally equi-spaced about the collar 19 and with three prongs 13 are substancially one hundred twenty degrees apart about the collar 19.

Each prong 13 is located at the same acute angle 49 to the longitudinal axis 29 of the collar 19. The acute angle 49 is within the range of fifteen degrees to seventeen degrees. Preferably, the acute angle 49 is fifteen degrees.

As also seen in FIG. 1, a signaling unit 51 is located in each prong 13. The location of the signaling unit 51 is not essential for operational reasons but toward the base 43 is the best location as the prongs 13 have their greatest structural size toward the base 43.

The signaling unit 51 may utilize many forms, but preferably the signaling unit 51, is a transponder which operates with the Global Positioning System (G.P.S.). A signaling unit 51 of this type is, in essence, a chip; Verichip Corporation and Applied Digital Solutions produce such chips.

The signaling unit 51 may operate in a variety of ways. The signaling unit may be energized on impact or may be energized by a signal. Regardless of how the signaling unit 51 is energized, the signaling unit 51 emits a signal that locates the signaling unit 51. Location of the signaling unit 51 thereby locates the wounded animal.

Figure 2:
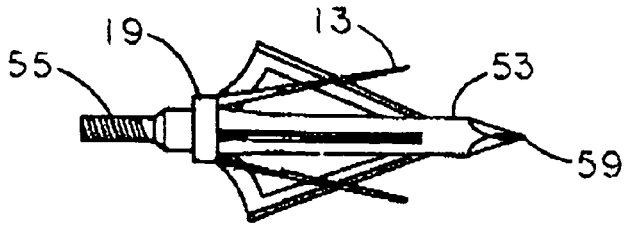
FIG. 2 is a side elevation of the Device mounted on the head of an arrow.
Figure 3:
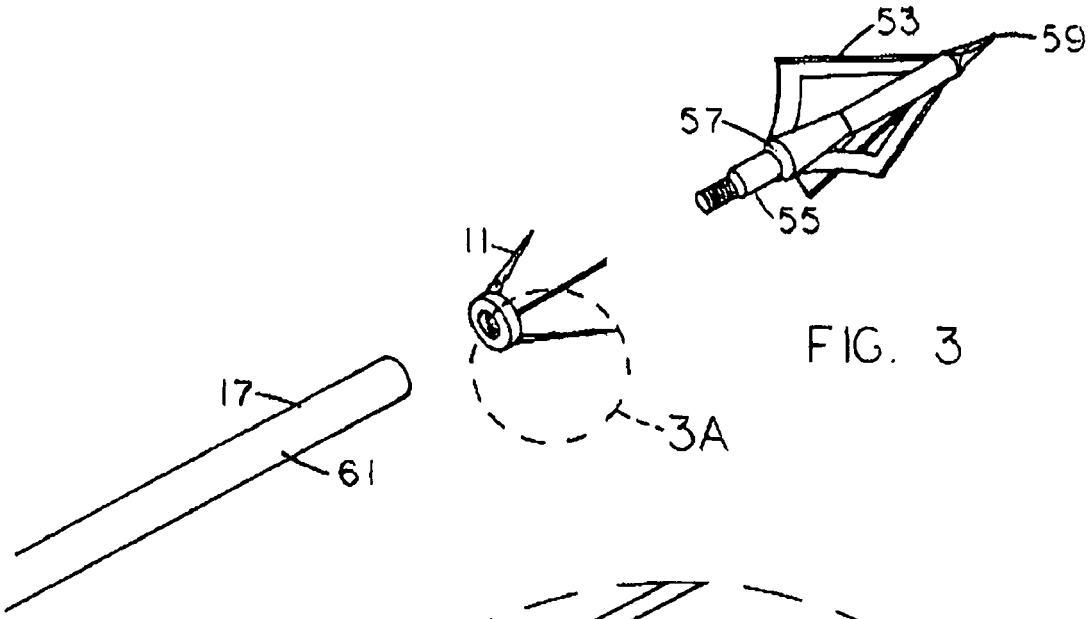
FIG. 3 is an exploded pictorial of the Device mounted on the head of an arrow adjacent the shaft.
Figure 3A:
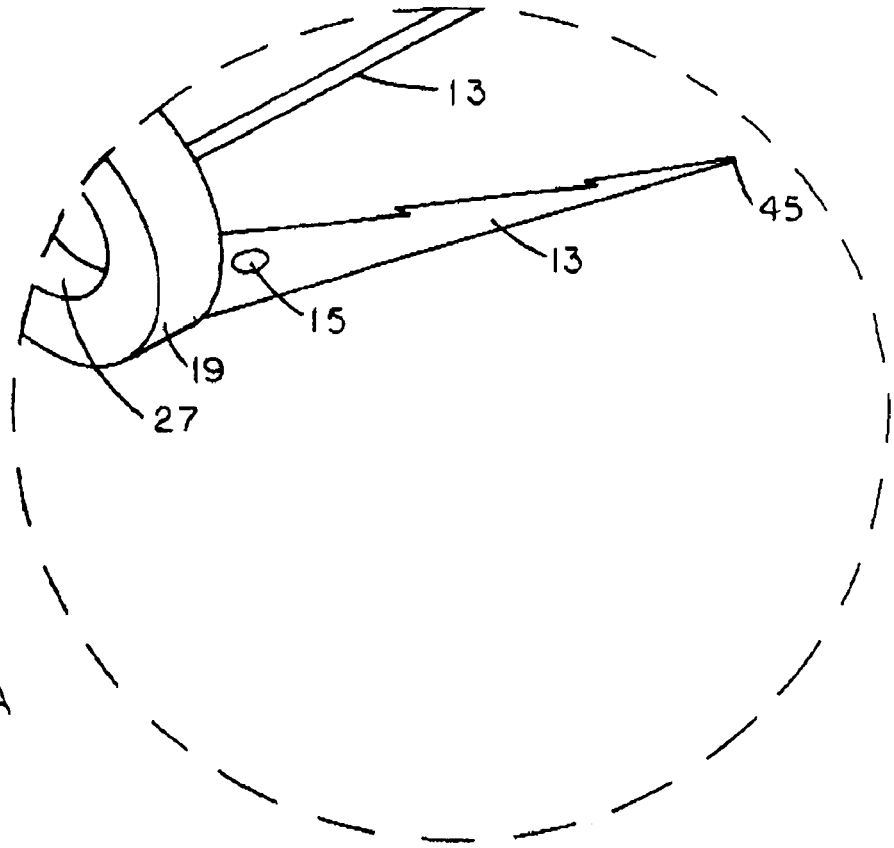
FIG. 3A is an enlarged view of one prong shown in FIG. 3.

In FIG. 2 and FIG. 3, a head 53 for an arrow 17 is shown. The head 53 has a shank 55 which is cylindrical and which is located at the back end 57 of the head 53. The back end 57 of the head is the opposite end from which a point 59 is located that initially penetrates the animal 39. Extending from the shank 55 is a shaft 61 of the arrow 17 as shown in FIG. 3. The shaft 61 is threaded into the shank 55.

The collar 19 is placed over the shank (FIG. 2) with the prongs 13 pointing in the general direction of the point 59 of the head 53. The attachment of the shaft 61 of the arrow 17 onto the shank 55 of the head 53 retains the pronged device 11 in place on the head 53.

Figure 4:
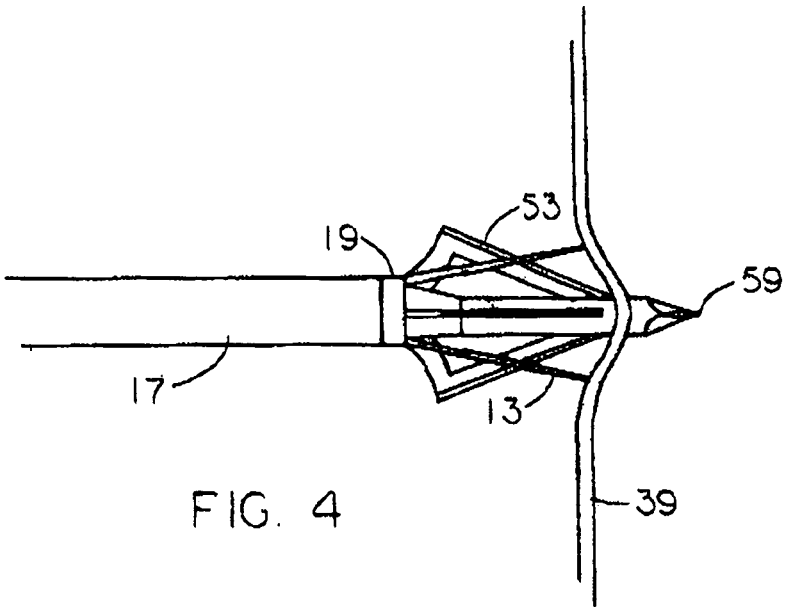
FIG. 4 is a side elevation of an arm head with the Device mounted on it initially piercing the skin of an animal.

As seen in FIG. 4 as the point 59 of the point 59 begins penetration of an animal 39, the prongs 13 also pierce the animal 39. It is possible that the arrow 17 with the head 53 will fall from the animal 39 but, even with an arrow 17 that strikes the animal 39 at an angle, at least one prong 13 will attach to the animal 39. Three prongs 13 have been selected as the optimum balance between weight and certainty of at least one prong 13 penetrating and becoming attached to the animal 39 regardless of the angle at which the animal 39 is struck. However, a lesser or greater number of prongs 13 could be used.

Figure 5:
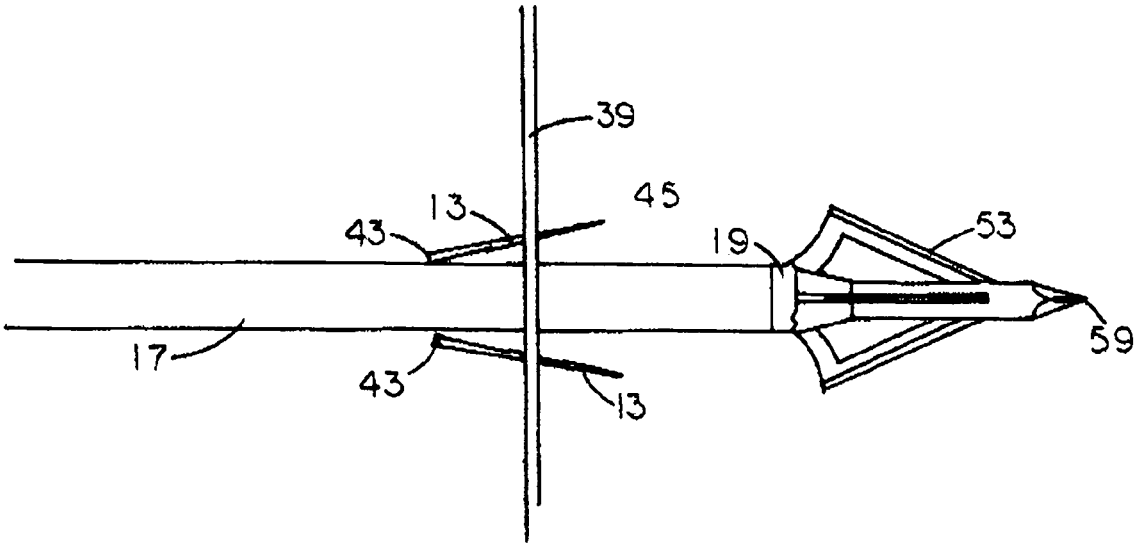
FIG. 5 is a side elevation similar to FIG. 4 but with the head of the arrow having penetrated deeply into the animal beyond the skin with the prongs broken off the head and partially penetrated into the skin of the animal.

In FIG. 5 the arrow 17 is shown as having penetrated well into the animal 39. As previously described, the prongs 13 are perforated at their base 43 as to break off on impact of the prong 13 with the animal 39. Thus, as shown in FIG. 5, the prongs 13 remain behind the arrow 17 as the arrow 17 penetrates the animal 39 but leaves the prongs 13 or at least one prong 13 in the animal 39. Should the animal 39, although possibly even seriously wounded, be able to continue to be mobile, the other signaling unit 51 or signaling units 51 will provide a dependable way to locate the animal 39.

While a preferred embodiment is shown and described herein, it should be understood that the present disclosure is made by way of example only and that variations in the described Wounded Animal Tracker and it's uses are possible within the scope of the following claims, and reasonable equivalency thereof, which claims 1 regard as my invention.

The invention claimed is:

1. A device for Locating a Wounded Animal for mounting on an arrow having a head and shaft, the Device being mounted on the head adjacent the shaft, such Device comprising:

a collar;

at least one prong mounted on the collar at an acute angle to the collar and having a base connected to the collar and a tip being pointed;

the prong being perforated adjacent to the collar; and a signaling unit mounted in the prong.

2. The Device for Locating a Wounded Animal according to claim 1 wherein there are three prongs.

3. The Device for Locating a Wounded Animal according to claim 1 where in there are three prongs equi-spaced about the collar.

4. The Device for Locating a Wounded Animal according to claim 1 wherein there are three prongs equi-spaced about the collar, all three prongs being substantially identical as to size and shape.

5. The Device according to claim 1 wherein the prong has a base end and a tip, the base being attached to the collar.

6. The Device according to claim 1 wherein the prong has a base and a tip, the base being attached to the collar, the prong being tapered from the base to the tip.

7. A device for Locating a Wounded Animal for mounting on an arrow having a head and a shaft, the Device being mounted on the head adjacent the shaft, such Device comprising;

a collar having a circular cross section;

a plurality of prongs mounted on the collar substantially equal distance from one another, each prong having a base and a tip, the base being attached to the collar, the tip being pointed, each prong being mounted on the collar at substantially the same acute angle to the collar and in the same general direction, each prong having two edges, at least one of the edges being jagged, each prong having a perforation at the base; and a signaling unit to transmit a signal located in each prong.

8. The Device for Locating a Wounded Animal according to claim 7 wherein there are three prongs.

9. The Device for Locating a Wounded Animal according to claim 7 wherein there are three prongs and all three prongs are substantially identical as to size and shape.

10. The Device for Locating a Wounded Animal according to claim 7 where in the two edges include an outside edge directed away from the collar and an inside edge directed toward the collar, the inside edge being the jagged edge.

11. A device for Locating an Wounded Animal for mounting on an arrow having a head and shaft, the Device being mounted on the head adjacent the shaft, such Device comprising:

a collar having a circular cross section with a passageway through it and having a front side and a rear side;

three prongs mounted on the collar approximately one-hundred twenty degrees from one another, the three prongs being substantially identified as to size and shape, each prong having a base attached to the collar and a tip remote from the base, the tip being pointed, each prong being included generally at the same acute angle to the collar, each prong having an inside edge located toward the collar, the inside edge being jagged, each prong having perforations adjacent to the collar; and a signaling unit which transmits a signal located in each prong.

12. A Device for Locating a Wounded Animal according to claim 11 wherein the signaling unit operates as part of the Global Positioning System.

* * * * *